US011565521B2

(12) United States Patent
Chen et al.

(10) Patent No.: US 11,565,521 B2
(45) Date of Patent: Jan. 31, 2023

(54) FLUID EJECTION DEVICE WITH A PORTIONING WALL

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 275 days.

(21) Appl. No.: 16/096,019

(22) PCT Filed: Jul. 26, 2016

(86) PCT No.: PCT/US2016/044082
§ 371 (c)(1),
(2) Date: Oct. 24, 2018

(87) PCT Pub. No.: WO2018/022019
PCT Pub. Date: Feb. 1, 2018

(65) Prior Publication Data

US 2019/0134977 A1 May 9, 2019

(51) Int. Cl.

| | |
|---|---|
| ***B41J 2/14*** | (2006.01) |
| ***B41J 2/16*** | (2006.01) |
| ***B41J 2/145*** | (2006.01) |

(52) U.S. Cl.
CPC ..... *B41J 2/1404* (2013.01); *B41J 2/145* (2013.01); *B41J 2/14088* (2013.01);
(Continued)

(58) Field of Classification Search
None
See application file for complete search history.

(56) References Cited

U.S. PATENT DOCUMENTS 5,563,642 A 10/1996 Keefe et al.
5,666,143 A 9/1997 Burke et al.
(Continued)

FOREIGN PATENT DOCUMENTS

CN 1253037 4/2006
CN 1827375 9/2006
(Continued)

OTHER PUBLICATIONS

Tseng, F-G., et at. A High-resolution High-frequency Monolithic Top-shooting Microinjector Free of Satellite Drops—Part I: Concept, Design, and Model, 2002, < http://ieeexplore.ieee.org/stamp/stamp.jsp?arnumber=1038836 >.

*Primary Examiner* — Erica S Lin
(74) *Attorney, Agent, or Firm* — Foley & Lardner LLP

(57) ABSTRACT

According to an example, a fluid ejection device may include a membrane including a first column of firing chambers, a second column of firing chambers, and a portioning wall, in which the portioning wall physically separates the first column of firing chambers from the second column of firing chambers. The fluid ejection device may also include a plurality of actuators and a substrate including a respective hole extending through the substrate from each of the firing chambers, in which an actuator of the plurality of actuators is provided in each of the firing chambers.

14 Claims, 5 Drawing Sheets

(52) U.S. Cl.
CPC ..... *B41J 2/1603* (2013.01); *B41J 2/1626* (2013.01); *B41J 2/1631* (2013.01); *B41J 2002/14403* (2013.01)

(56) References Cited

U.S. PATENT DOCUMENTS

| | | | | |
|---|---|---|---|---|
| 6,280,021 | B1 | 8/2001 | Wa et al. | |
| 6,419,346 | B1 | 7/2002 | Nikkei | |
| 6,543,879 | B1 | 4/2003 | Feinn et al. | |
| 6,561,632 | B2 | 5/2003 | Feinn et al. | |
| 7,014,298 | B2 | 3/2006 | Silverbrook | |
| 2002/0097302 | A1 | 7/2002 | Nikkel | |
| 2002/0163563 | A1* | 11/2002 | Blair | B41J 2/1404 347/65 |
| 2003/0005883 | A1* | 1/2003 | Feinn | B41J 2/1404 118/313 |
| 2003/0071865 | A1 | 4/2003 | Mott et al. | |
| 2003/0081027 | A1 | 5/2003 | Feinn et al. | |
| 2006/0181580 | A1* | 8/2006 | Lee | B41J 2/14233 347/68 |
| 2006/0197809 | A1* | 9/2006 | Tobita | B41J 2/14274 347/71 |
| 2006/0268067 | A1 | 11/2006 | Agarwal | |
| 2009/0128605 | A1 | 5/2009 | Ide | |
| 2012/0274707 | A1 | 11/2012 | Cai et al. | |
| 2013/0021405 | A1 | 1/2013 | Fang et al. | |

FOREIGN PATENT DOCUMENTS

| | | | |
|---|---|---|---|
| CN | 101765510 | | 6/2010 |
| CN | 101965131 | | 2/2011 |
| CN | 105102230 | | 11/2015 |
| EP | 1310366 | B1 | 12/2007 |
| JP | 2006272948 | | 10/2006 |
| JP | 2006272984 | | 10/2006 |
| JP | 2009125970 | | 6/2009 |
| JP | 2016083881 | | 5/2016 |
| RU | 2163218 | C2 | 2/2001 |
| WO | WO-2014126559 | A1 | 8/2014 |

* cited by examiner

FLUID EJECTION DEVICE WITH A PORTIONING WALL

BACKGROUND

Thermal inkjet printheads eject fluid ink drops from nozzles by passing electrical current through resistor elements contained in a firing chamber. Heat from a resistor element creates a rapidly expanding vapor bubble that forces a small ink drop out of a nozzle of the firing chamber. When the resistor element cools, the vapor bubble quickly collapses and draws more fluid ink into the firing chamber in preparation for ejecting another drop through the nozzle. Fluid ink is drawn from a reservoir via a fluid slot that extends through the substrate on which the resistor element and the firing chamber are formed.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1A:
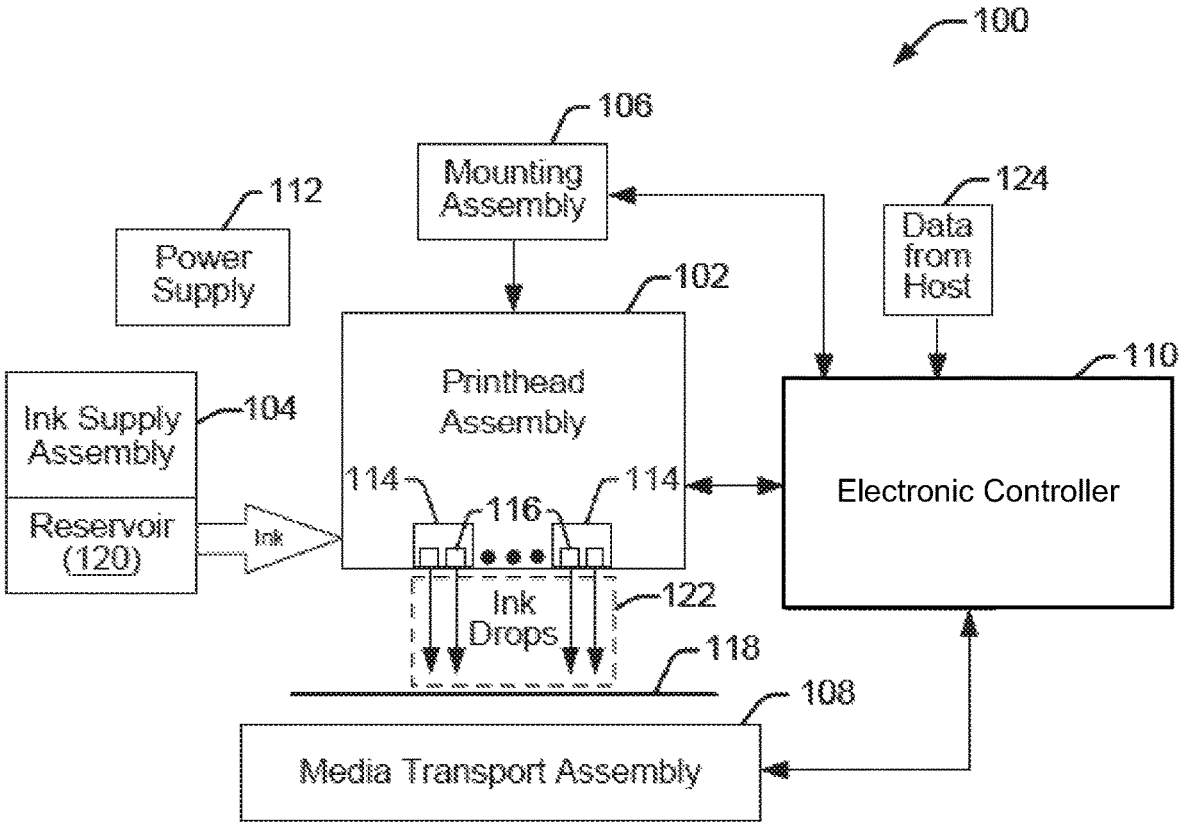
FIG. 1A depicts a simplified a simplified block diagram of an example inkjet printing system.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Additionally, it should be understood that the elements depicted in the accompanying figures may include additional components and that some of the components described in those figures may be removed and/or modified without departing from scopes of the elements disclosed herein. It should also be understood that the elements depicted in the figures may not be drawn to scale and thus, the elements may have different sizes and/or configurations other than as shown in the figures.

Disclosed herein are fluid ejection devices and methods for fabricating the fluid ejection devices. The fluid ejection devices, which may also be termed printheads, may be provided on a printhead assembly and may be implemented to deliver droplets of fluid, e.g., ink, onto a media. As discussed herein, the fluid ejection devices may include a plurality of firing chambers arranged in a first column and in a second column, in which an actuator is situated in each of the firing chambers. The first column of firing chambers may be physically separated from the second column of firing chambers by a portioning wall. That is, the portioning wall may block direct fluidic paths between the firing chambers in the first column to the firing chambers in the second column. The tops and bottoms of the firing chambers may also prevent direct fluid paths from being formed between the firing chambers.

In one regard, therefore, fluidic paths between the firing chambers in the first column and the firing chambers in the second column may follow a more circuitous path, which may result in fluidic paths having relatively long distances. That is, for instance, the fluidic paths between the firing chambers may be required to go through multiple fluid feed holes as well as a fluid feed slot. In one regard, through implementation of various features in the fluid ejection devices disclosed herein, cross-talk between the firing chambers in the respective columns of firing chambers may be reduced, minimized, or eliminated.

Cross-talk may be defined as occurring when fluid is ejected through a nozzle corresponding to a firing chamber in one column when an actuator in a firing chamber in another column is activated. That is, when cross-talk occurs, fluid may be unintentionally ejected through a nozzle, which may result in visible printing defects. Cross-talk may occur if a fluidic path between the firing chambers is below a threshold level. The threshold level may be based upon the types and sizes of the actuators, may differ for different configurations, and may be determined through testing. The portioning wall disclosed herein may block the direct fluidic paths between the actuators in the first column and the actuators in the second column thus causing the fluidic paths to be larger than the threshold level.

Through implementation of the fluid ejection devices disclosed herein, the distances between the nozzles of the firing chambers in opposing columns of firing chambers may be relatively smaller than may be possible in fluid ejection devices in which cross-talk may be an issue. That is, for instance, the portioning wall disclosed herein may enable for the nozzles of the firing chambers in opposing columns of firing chambers to be positioned in relatively close proximities to each other, e.g., around 100 microns, without a significant risk of cross-talk occurring. In one regard, placing the nozzles of the firing chambers in opposing columns in close proximities to each other may result in higher quality printing, e.g., reduced printed line width. Additionally, the closer proximities of the nozzles may enable a higher nozzle packaging density, a cooler fluid ejection device, etc.

With reference first to FIG. 1A, there is shown a simplified block diagram of an example inkjet printing system 100. The inkjet printing system 100 is depicted as including a printhead assembly 102, an ink supply assembly 104, a mounting assembly 106, a media transport assembly 108, an electronic controller 110, and a power supply 112 that provides power to the various electrical components of the inkjet printing system 100. The printhead assembly 102 is also depicted as including a fluid ejection devices 114 (or, equivalently, printheads 114) that eject drops of ink through a plurality of orifices or nozzles 116 toward a print media 118 so as to print on the print media 118.

The print media 118 may be any type of suitable sheet or roll material, such as paper, card stock, transparencies, Mylar, and the like. The nozzles 116 may be arranged in one or more columns or arrays such that properly sequenced ejection of ink from the nozzles 116 causes characters, symbols, and/or other graphics or images to be printed on print media 118 as the printhead assembly 102 and print media 118 are moved relative to each other. As discussed in greater detail herein, the columns of nozzles may be positioned in close proximity to each other and may be separated by a portioning wall. For instance, the nozzles in one column may be separated from the nozzles in another column by a distance that is less than about 100 microns.

The ink supply assembly 104 may supply fluid ink to the printhead assembly 102 and, in one example, includes a reservoir 120 for storing ink such that ink flows from the reservoir 120 to the printhead assembly 102. The ink supply assembly 104 and the printhead assembly 102 may form a one-way ink delivery system or a recirculating ink delivery system. In one example, the printhead assembly 102 and the ink supply assembly 104 are housed together in an inkjet cartridge or pen. In another example, the ink supply assembly 104 is separate from printhead assembly 102 and supplies ink to the printhead assembly 102 through an interface connection, such as a supply tube. In either example, the reservoir 120 of ink supply assembly 104 may be removed, replaced, and/or refilled. Where the printhead assembly 102 and the ink supply assembly 104 are housed together in an inkjet cartridge, the reservoir 120 may include a local reservoir located within the cartridge as well as a larger reservoir located separately from the cartridge.

The mounting assembly 106 may position the printhead assembly 102 relative to the media transport assembly 108, and the media transport assembly 108 may position the print media 118 relative to the printhead assembly 102. Thus, a print zone 122 may be defined adjacent to the nozzles 116 in an area between the printhead assembly 102 and the print media 118. In one example, the printhead assembly 102 is a scanning type printhead assembly in which the mounting assembly 106 may include a carriage for moving the printhead assembly 102 relative to the media transport assembly 108 to scan across the print media 118. In another example, the printhead assembly 102 is a non-scanning type printhead assembly. In this example, the mounting assembly 106 fixes the printhead assembly 102 at a prescribed position relative to the media transport assembly 108. Thus, the media transport assembly 108 may position the print media 118 relative to the printhead assembly 102.

The electronic controller 110 may include a processor, firmware, software, one or more memory components including volatile and non-volatile memory components, and other printer electronics for communicating with and controlling the printhead assembly 102, the mounting assembly 106, and the media transport assembly 108. The electronic controller 110 may receive data 124 from a host system, such as a computer, and may temporarily store the data 124 in a memory (not shown). The data 124 may be sent to the inkjet printing system 100 along an electronic, infrared, optical, or other information transfer path. The data 124 may represent, for example, a document and/or file to be printed. As such, the data 124 may form a print job for the inkjet printing system 100 and may include one or more print job commands and/or command parameters.

In one example, the electronic controller 110 controls the printhead assembly 102 for ejection of ink drops from the nozzles 116. Thus, the electronic controller 110 may define a pattern of ejected ink drops which form characters, symbols, and/or other graphics or images on the print media 118. The pattern of ejected ink drops may be determined by the print job commands and/or command parameters.

The printhead assembly 102 may include a plurality of fluid ejection devices (printheads) 114. In one example, the printhead assembly 102 is a wide-array or multi-head printhead assembly. In one implementation of a wide-array assembly, the printhead assembly 102 includes a carrier that carries the plurality of fluid ejection devices 114, provides electrical communication between the fluid ejection devices 114 and the electronic controller 110, and provides fluidic communication between the fluid ejection devices 114 and the ink supply assembly 104.

In one example, the inkjet printing system 100 is a drop-on-demand thermal inkjet printing system in which the fluid ejection devices 114 are thermal inkjet (TIJ) printheads. The thermal inkjet printheads may implement thermal resistor ejection elements in an ink chamber to vaporize ink and create bubbles that force ink or other fluid drops out of the nozzles 116. In another example, the inkjet printing system 100 is a drop-on-demand piezoelectric inkjet printing system in which the fluid ejection devices 114 are piezoelectric inkjet (PIJ) printheads that implement piezoelectric material actuators as ejection elements to generate pressure pulses that force ink drops out of the nozzles 116.

Figure 1B:
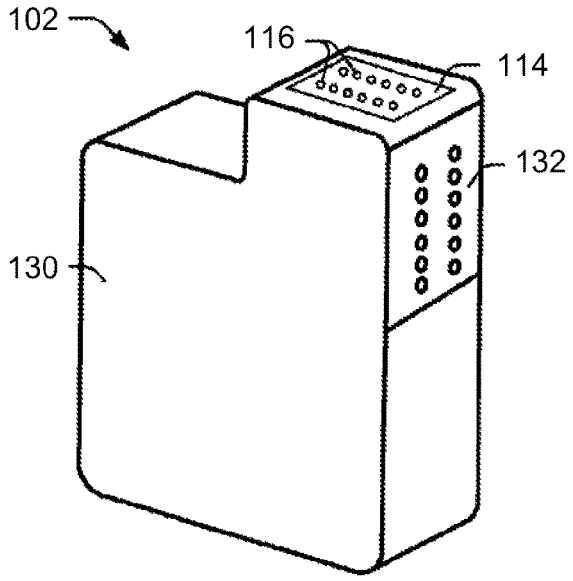
FIG. 1B shows an example printhead assembly implemented as an ink cartridge.

Turning now to FIG. 1B, there is shown an example printhead assembly 102 implemented as an ink cartridge. The printhead assembly 102 may include a cartridge body 130, a fluid ejection device 114, and electrical contacts 132. Individual fluid drop generators within the fluid ejection device 114 may be energized by electrical signals provided at the contacts 132 to eject fluid drops from selected nozzles 116. The fluid may be any suitable fluid used in a printing process, such as various printable fluids, inks, pre-treatment compositions, fixers, and the like. In some examples, the fluid may be a fluid other than a printing fluid. The printhead assembly 102 may include an ink supply 104 within the cartridge body 130, or the printhead assembly 102 may receive fluid from an external ink supply 104, for instance, as shown in FIG. 1A.

Figure 2A:
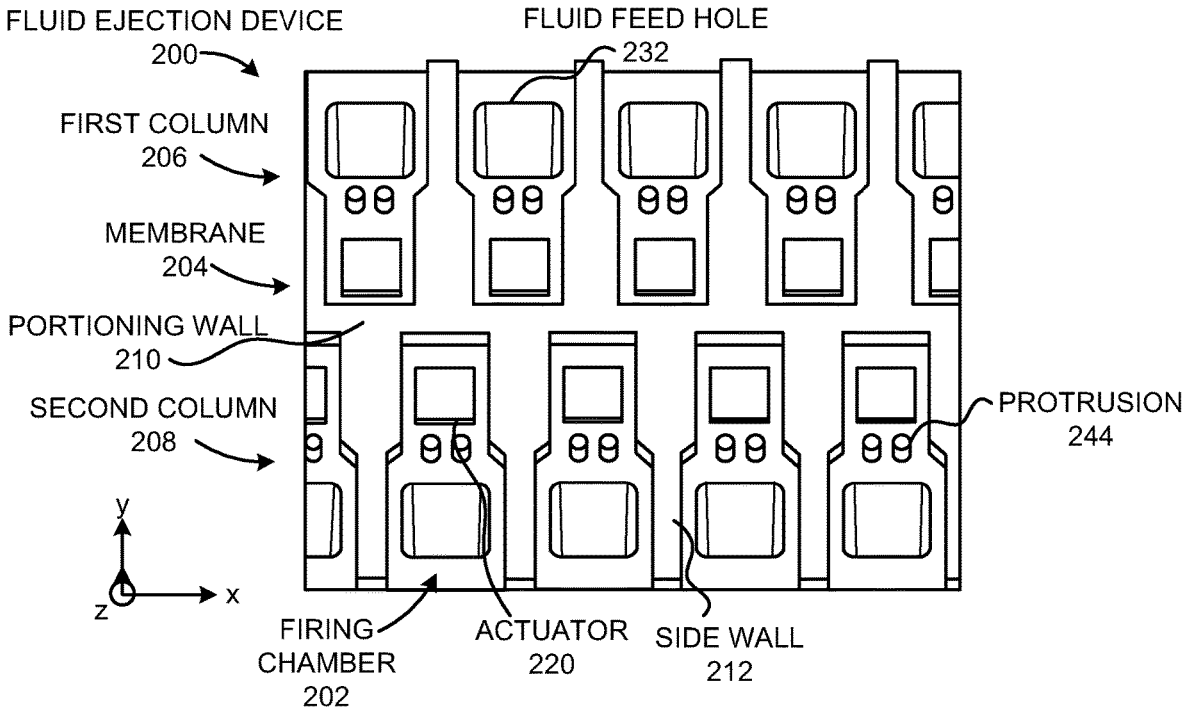
FIGS. 2A and 2B, respectively, show a top view and a perspective view of a portion of an example fluid ejection device.
Figure 2B:
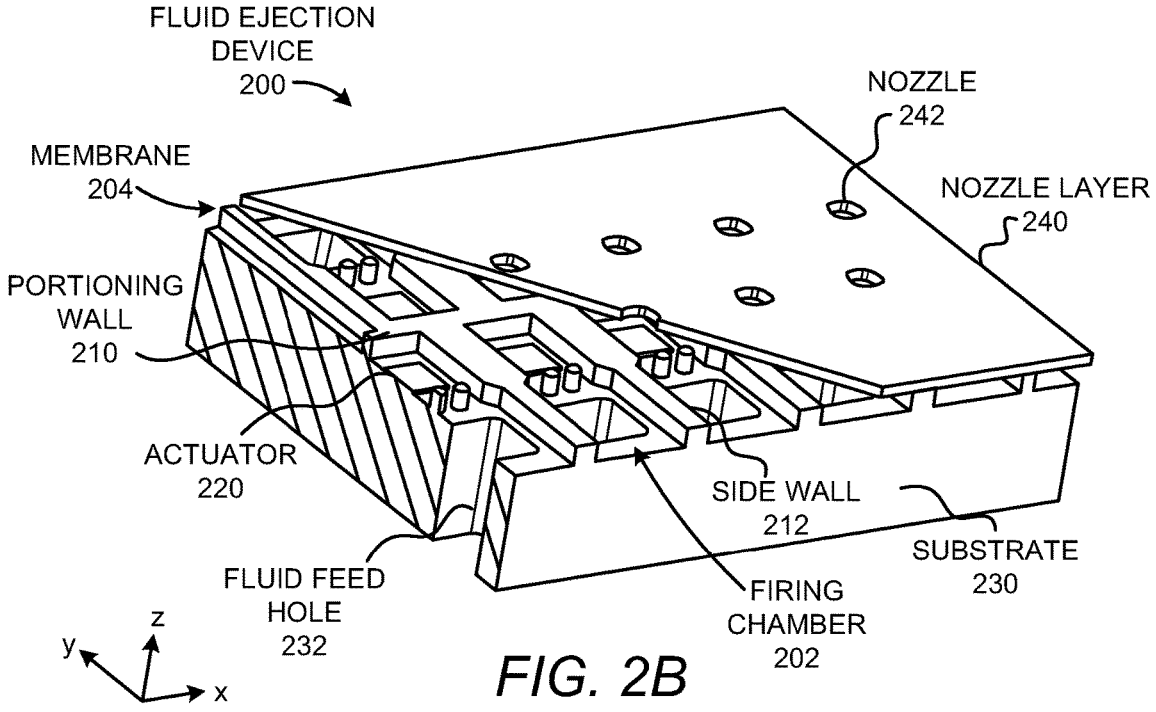

With reference now to FIGS. 2A and 2B, there are respectively shown a top view and a perspective view of a portion of an example fluid ejection device 200. The fluid ejection device 200 depicted in FIGS. 2A and 2B may be equivalent to the fluid ejection device 114 depicted in FIGS. 1A and 1B. Thus, for instance, the fluid ejection device 200 depicted in FIGS. 2A and 2B may be provided on or as part of a printhead assembly 102. In addition, the fluid ejection device 114 depicted in FIGS. 1A and 1B may include the portion of the fluid ejection device 200 shown in FIGS. 2A and 2B in a repeated manner along a length of the fluid ejection device 114.

The portion of the fluid ejection device 200 depicted in FIGS. 2A and 2B, which may be representative of the entire length of a fluid ejection device 200, may include a plurality of firing chambers 202 formed in a membrane 204. The membrane 204 may include a material that may be used in semiconductor component fabrication, such as SU-8, which is an epoxy-based negative photoresist. The membrane 204 may also include other types of materials, such as polymers, plastics, or the like. In any regard, the firing chambers 202 may be formed, for instance, through etching of the membrane 204.

The fluid ejection device 200 may include a first column 206 of firing chambers 202 and a second column 208 of firing chambers 202. That is, a first group of firing chambers 202 is provided along the first column 206 and a second group of firing chambers 202 is provided along the second column 208. As shown in FIGS. 2A and 2B, the firing chambers 202 in the first group, i.e., in the first column 206, may be offset from the firing chambers 202 in the second group, i.e., in the second column 208, along the x-dimension with respect to the direction in which the firing chambers 202 are arranged in the columns 206 and 208. In addition, the firing chambers 202 in the first column 206 may be physically separated from the firing chambers 202 in the second column 208 by a portioning wall 210. That is, the portioning wall 210 may form a barrier between the firing chambers 202 in the first column 206 and the firing chambers 202 in the second column 208 and may thus extend the entire length or nearly the entire length of the fluid ejection device 200, i.e., along the x-dimension. According to an example, the portioning wall 210 may have a thickness, i.e., along the y-dimension, that is between about 5 microns to about 500 microns. The portioning wall 210 may also have a height, i.e., along the z-dimension, that is between about 10 microns to about 100 microns.

The firing chambers 202 are also depicted as including side walls 212 that may physically separate the firing chambers 202 in the first column 206 from each other and the firing chambers 202 in the second column 208 from each other. The side walls 212 may be formed in the membrane 204 during formation of the firing chambers 202. Although not shown in FIGS. 2A and 2B, the firing chambers 202 may also include back walls that may connect the side walls 212 of adjacent firing chambers 202 at distal ends of the sidewalls 212 from the portioning wall 210. Thus, for instance, a first back wall (not shown) may extend across the rear sections of the firing chambers 202 in the first column 206 and a second back wall (not shown) may extend across the rear sections of the firing chambers 202 in the second column 208. The rear walls, if present, may act as barriers for fluid from flowing from one firing chamber 202 to another firing chamber 202 in a column 206, 208 through the rear sections of the firing chambers 202.

As also shown in FIGS. 2A and 2B, an actuator 220 may be provided in each of the firing chambers 212. The actuators 220 may be thermal resistors, piezoelectric devices, magnetoresistive devices, or the like, as discussed above. In addition, as also discussed above, an electronic controller 110 may control the actuators 220 through electrical connections. In any regard, the actuators 220 are to generate pressure pulses that cause some of the fluid contained in the firing chambers 202 to be expelled from the firing chambers 202. As shown in FIGS. 2A and 2B, the actuators 220 in the first column 206 of firing chambers 202 may be in relatively close proximities to neighboring actuators 220 in the second column 208 of firing chambers 202. For instance, the distances between the actuators 220 in the first column 206 and the nearest neighbor actuators 220 in the second column 208 may be less than may be achievable in fluid ejection devices that do not contain the portioning wall 210. By way of particular example, the distances may be less than about 200 microns. As another example, the distances may be less than about 100 microns.

The fluid ejection device 200 may also include a substrate 230 upon which the membrane 204 may be attached and which may form a ceiling of the firing chambers 202. According to an example, the substrate 230 may be formed of silicon or other material, such as polymer, plastic, or the like. In any regard, a plurality of fluid feed holes 232 may be formed through the substrate 230 such that fluid from a fluid feed slot (not shown) may be supplied into the respective firing chambers 202. That is, each of the firing chambers 202 may include a respective fluid feed hole 232 through which fluid may be supplied into the firing chambers 202. With reference to FIG. 2B, the fluid feed slot may be provided on an opposite side of the substrate 230 from the membrane 204 and may be in fluid communication with each of the fluid feed slots 232.

As also shown in FIG. 2B, the fluid ejection device 200 may include a nozzle layer 240 containing a plurality of nozzles 242. Part of the nozzle layer 240 has been removed to show features of the fluid ejection device 200 beneath the nozzle layer 240. The nozzles 242 may be equivalent to the nozzles 116 depicted in FIGS. 1A and 1B. The nozzle layer 240 may be formed of a relatively rigid material, such as a metal, a plastic, a polymer, or the like. The nozzle layer 240 may be attached to the membrane 204 and floors of the firing chambers 202 may be formed by the nozzle layer 240. In addition, each of the nozzles 242 may be positioned directly beneath a respective actuator 220 as also shown in FIG. 2B.

Activation of an actuator 220 may cause part of the fluid contained in the firing chamber 202 in which the actuator 220 is provided to be ejected through the nozzle 242 positioned beneath the actuator 220. In addition, activation of the actuator 220 may cause fluid to be drawn into the firing chamber 202 from the fluid feed slot through the fluid feed hole 232 to fill the firing chamber 202 with fluid. As shown in FIGS. 2A and 2B, the sections of the sidewalls 212 that are closer to the portioning wall 210 may have larger widths than the sections of the sidewalls 212 that are away from the portioning wall 210. That is, for instance, the side walls 212 may form pinched sections through which fluid may be supplied over the actuators 220. According to an example, the amount of pinching formed by the side walls 212 may be selected to tune ejection of the fluid through the nozzle 242. The ejection of the fluid through the nozzle 242 may further be tuned by the placement of protrusions 244 in the fluid paths from the fluid feed holes 232 to the actuators 220. The protrusions 244 may also function to block particles from being drawn over the actuators 220.

As discussed herein, cross-talk may be defined as occurring when fluid is ejected through a nozzle 242 corresponding to a firing chamber 202 in one column 206 when an actuator 220 in a firing chamber 202 in another column 208 is activated. That is, when cross-talk occurs, fluid may be unintentionally ejected through a nozzle 242, which may result in printing defects. In addition, cross-talk among firing chambers 202 may occur if a fluidic path between the firing chambers 202 is below a threshold level. The threshold level may be based upon the types and sizes of the actuators 220. Thus, for instance, the threshold level at which cross-talk may occur among the actuators 220 may be determined through testing and may vary for different configurations. The portioning wall 210 may block the direct fluidic paths between the firing chambers 202 in the first column 206 and the firing chambers 202 in the second column 208. Instead, the fluidic paths between these firing chambers 202 may extend through respective fluid feed holes 232 as well as the distance between the fluid feed holes 232 through the fluid feed slot. In one regard, therefore, the portioning wall 210 may enable the actuators 220 in the respective columns 206 and 208 to be positioned in close proximities to each other, e.g., around 100 microns, without substantial risk of cross-talk among the firing chambers 202 in which those actuators 220 are positioned.

According to an example, the substrate 230 may have a thickness, i.e., in the z-dimension, that is at least 100 microns. In this regard, in order for cross-talk to occur between a firing chamber 202 of the first column 206 and a nearest neighbor firing chamber 202 in the second column 206, a pressure wave formed through activation of the actuator 220 in the firing chamber 202 of the first column 206 may need to traverse at least two fluid feed holes 232 and the distance between the two fluid feed holes 232. In an example in which the height of each of two fluid feed holes 232 is 100 microns and distance between the fluid feed holes 232 is 200 microns, the length of the fluidic path between the nearest neighbor firing chambers 202 in the first and second columns 206, 208 may at least be 400 microns. Thus, for instance, the distance between the neighboring firing chambers 202 may be substantially larger than the threshold level at which cross-talk may occur.

Figure 3A:
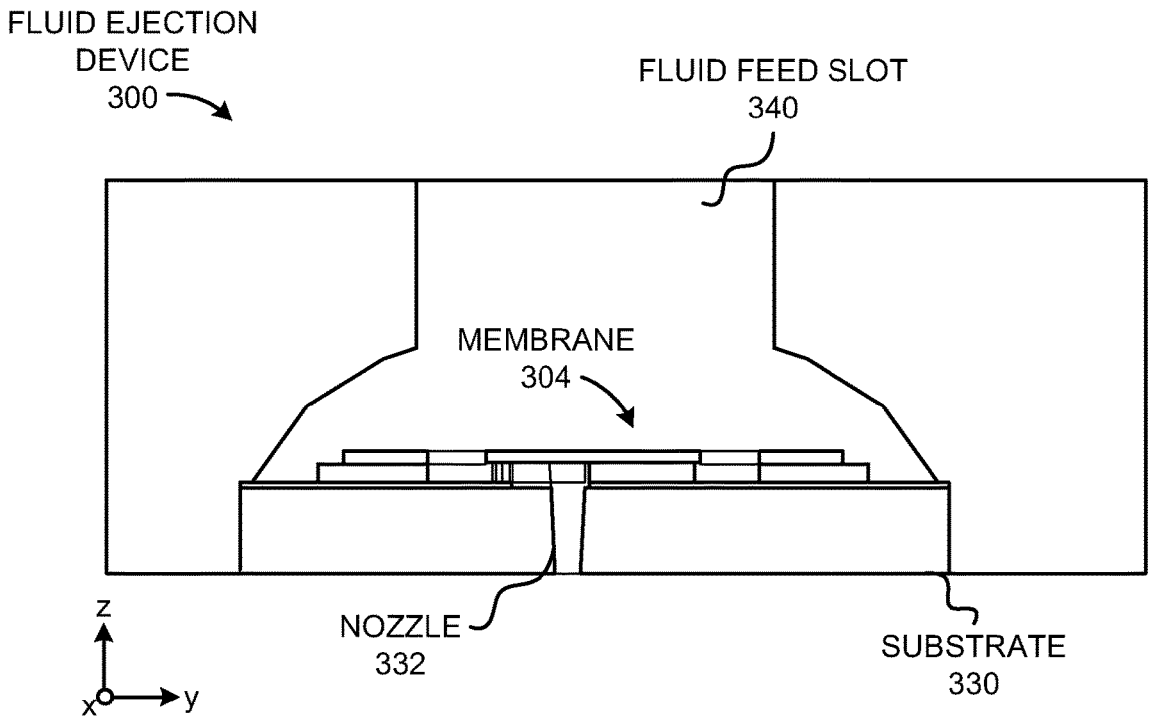
FIGS. 3A, 3B, and 3C, respectively, show a cross-sectional top view, a partially cut-away top view, and a perspective view of portions of another example fluid ejection device.
Figure 3B:
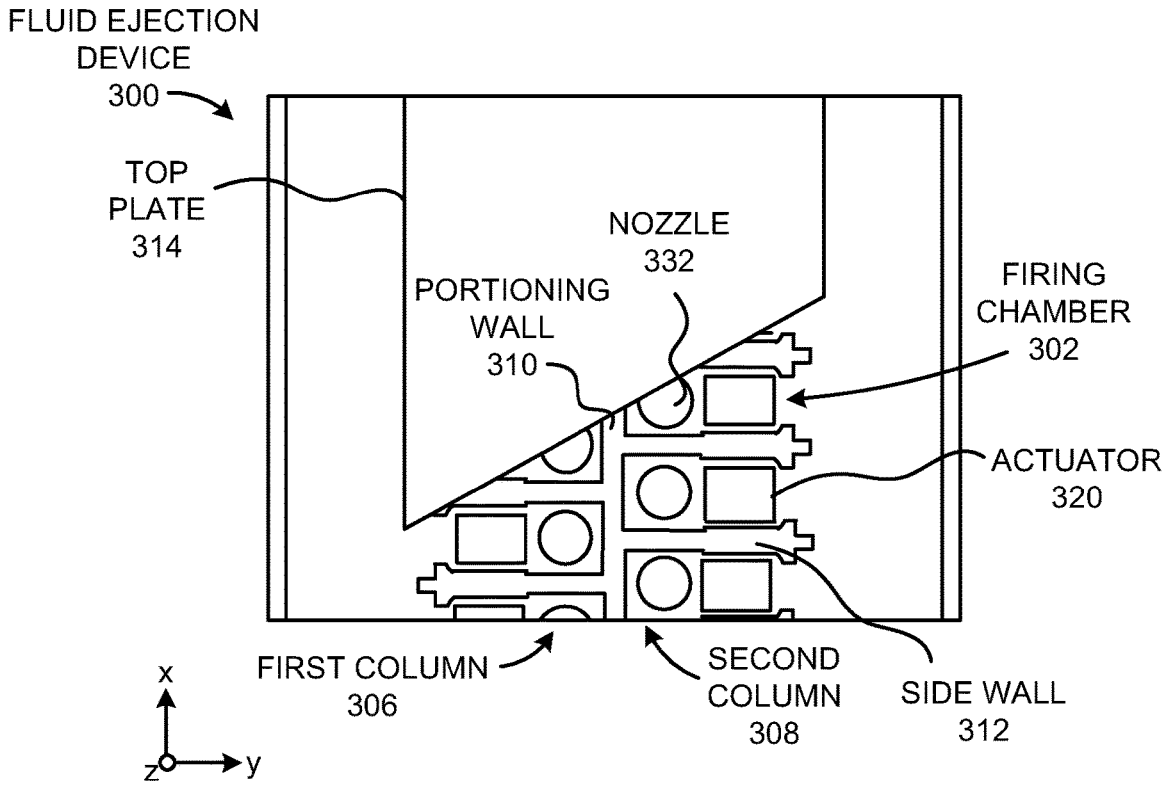
Figure 3C:
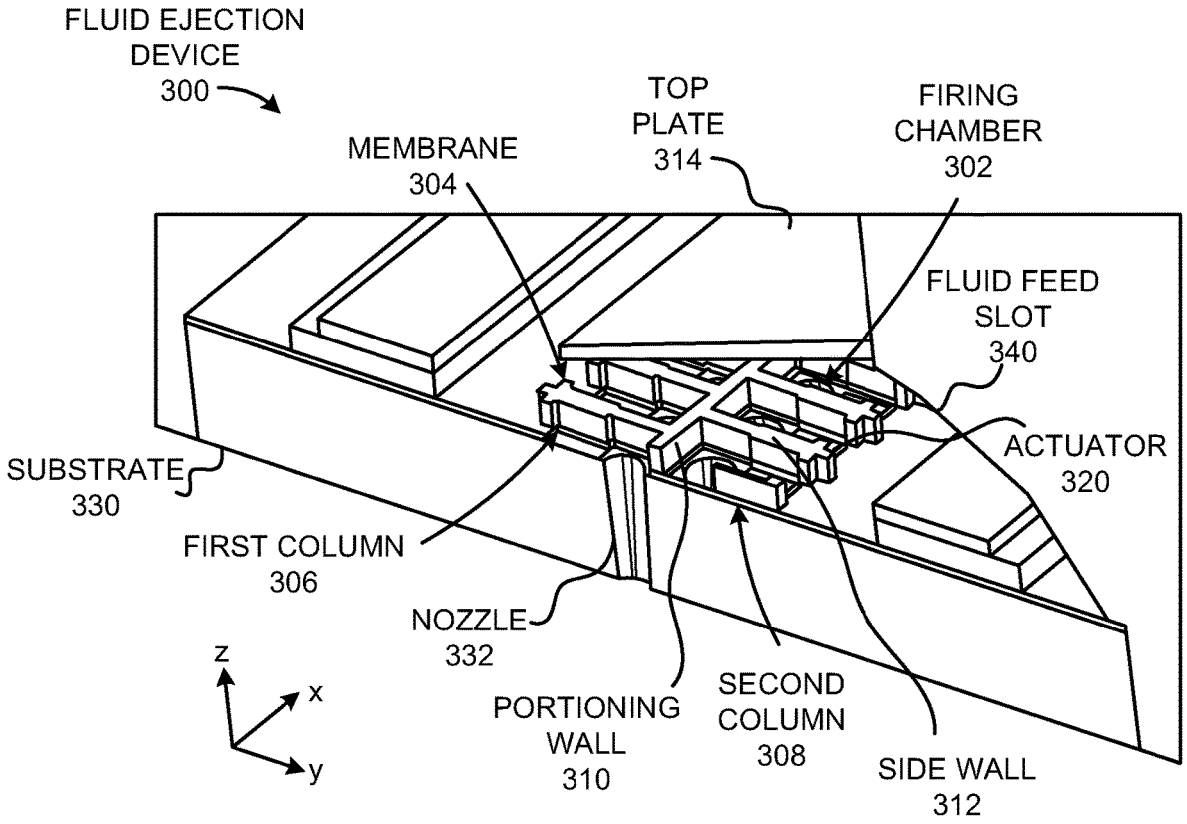

With reference now to FIGS. 3A, 3B, and 3C, there are respectively shown a cross-sectional top view, a partially cut-away top view, and a perspective view of portions of another example fluid ejection device 300. The fluid ejection device 300 depicted in FIGS. 3A, 3B, and 3C may be equivalent to the fluid ejection device 114 depicted in FIGS. 1A and 1B. Thus, for instance, the fluid ejection device 300 depicted in FIGS. 3A, 3B, and 3C may be provided on or as part of a printhead assembly 102. In addition, the fluid ejection device 114 depicted in FIGS. 1A and 1B may include the portion of the fluid ejection device 300 shown in FIGS. 3A, 3B, and 3C in a repeated manner along a length of the fluid ejection device 114.

The portion of the fluid ejection device 300 depicted in FIGS. 3A, 3B, and 3C, which may be representative of the entire length of a fluid ejection device 300, may include a plurality of firing chambers 302 formed in a membrane 304. The membrane 304 may include any of the materials discussed above with respect to the membrane 202 in FIGS. 2A and 2B. For instance, the membrane 302 may include SU-8, which is an epoxy-based negative photoresist. The walls of the firing chambers 302 may be formed, for instance, through etching of the membrane 304.

The fluid ejection device 300 may include a first column 306 of firing chambers 302 and a second column 308 of firing chambers 302. That is, a first group of firing chambers 302 may be provided along the first column 306 and a second group of firing chambers 302 may be provided along the second column 308. As shown in FIGS. 3B and 3C, the firing chambers 302 in the first group, i.e., in the first column 306, may be offset from the firing chambers 302 in the second group, i.e., in the second column 308, along the x-dimension with respect to the direction in which the firing chambers 302 are arranged in the columns 306 and 308. In addition, the firing chambers 302 in the first column 306 may be physically separated from the firing chambers 302 in the second column 308 by a portioning wall 310. That is, the portioning wall 310 may form a liquid barrier between the firing chambers 302 in the first column 306 and the firing chambers 302 in the second column 308 and may thus extend nearly the entire length of the fluid ejection device 300, i.e., along the x-dimension. According to an example, the portioning wall 310 may have a thickness, i.e., along the y-dimension, that is between about 5 microns to about 500 microns. The portioning wall 310 may also have a height, i.e., along the z-dimension, that is between about 10 microns to about 100 microns.

The firing chambers 302 are also depicted as including side walls 312 that may physically separate the firing chambers 302 in the first column 306 from each other and the firing chambers 302 in the second column 308 from each other. The side walls 312 may be formed in the membrane 304 during formation of the firing chambers 302. The fluid ejection device 300 may also include a top plate 314 that may form ceilings of the firing chambers 302 and may also act as a barrier for fluid from flowing from one firing chamber 302 to another firing chamber 302 over the tops of the side walls 312. The top plate 314 may be formed of the same or similar material as the membrane 304.

As also shown in FIGS. 3A, 3B, and 3C, an actuator 320 and a nozzle 332 may be provided in each of the firing chambers 312. For instance, the actuators 320 may be provided on a substrate 330 and the nozzles 332 may be formed through the substrate 330. The nozzles 332 may be equivalent to the nozzles 116 depicted in FIGS. 1A and 1B. The actuators 320 may be thermal resistors, piezoelectric devices, magnetoresistive devices, or the like, as discussed above. In addition, as also discussed above, the actuators 320 may be controlled by an electronic controller 110 through electrical connections. Although the actuators 320 have been depicted as being positioned near the opposite ends of the firing chambers 302 from the portioning wall 310, it should be understood that the actuators 320 and nozzles 332 may have other arrangements. For instance, the placements of the actuators 320 and the nozzles 332 may be switched. In other examples, the actuators 320 may have circular shapes and may be positioned around the nozzle 332.

In any regard, the actuators 320 may generate pressure pulses that cause some of the fluid contained in the firing chambers 302 to be expelled from the firing chambers 302 through the nozzles 332 in the substrate 330. The substrate 330 may be attached to the membrane 304 opposite the top plate 314 and may form floors of the firing chambers 302. The substrate 330 may be formed of any of the materials discussed above, for instance, silicon.

According to an example, the pressure pulse created by an actuator 320 may cause some of the fluid contained in a firing chamber 302 to be expelled through the nozzle 332. In the arrangement shown in FIGS. 3A, 3B, and 3C, the nozzles 332 in the first column 306 of firing chambers 302 may be in relatively close proximities to neighboring actuators 320 in the second column 308 of firing chambers 302. For instance, the distances between the nozzles 332 in the first column 306 and the nearest neighbor nozzles 332 in the second column 308 may be less than may be achievable in fluid ejection devices that do not contain the portioning wall 310. By way of particular example, the distances may be less than about 100 microns.

As shown in FIG. 3A, the fluid ejection device 300 may also include a fluid feed slot 340. The fluid feed slot 340 may be a chamber that contains fluid, such as ink, that may be delivered into the firing chambers 302. For instance, the entire fluid feed slot may be filled with fluid and as fluid is expelled through the nozzles 332, the firing chambers 302 may be refilled with fluid. That is, activation of an actuator 320 may cause fluid to be drawn into a firing chamber 302 from the fluid feed slot 340 through an opening between side walls 312 to fill the firing chamber 302 with fluid. As shown in FIGS. 3B and 3C, the sections of the sidewalls 312 that are closer to the portioning wall 310 may have smaller widths than the sections of the sidewalls 312 that are away from the portioning wall 310. That is, for instance, the side walls 312 may form pinched sections through which fluid may be supplied over the actuators 320. According to an example, the amount of pinching formed by the side walls 312 may be selected to tune the ejection of the fluid through the nozzle 332.

The portioning wall 310 may block the direct fluidic paths between the actuators 320 in the first column 306 and the nozzles 332 in the second column 308 of firing chambers 302. Instead, the fluidic paths between the actuators 320 and the nozzles 332 in opposite columns 306, 308 may extend out of the firing chambers 302 and over the top plate 314. In one regard, therefore, the portioning wall 310 may enable the nozzles 332 in the respective columns 306 and 308 to be positioned in close proximities to each other, e.g., around 100 microns, without substantial risk of cross-talk among the actuators 320 and the nozzles 332 in the opposite columns 306, 308. According to an example, the top plate 314 may have a width, i.e., in the y-dimension, that is at least 200 microns. In this regard, in order for cross talk to occur between an actuator 320 in a firing chamber 302 of the first column 306 and a nozzle 332 in a nearest neighbor firing chamber 302 in the second column 306, a pressure wave formed through activation of the actuator 320 in the firing chamber 302 of the first column 306 may need to traverse at least two 200 microns. Thus, for instance, the distance between the actuators 320 and nozzles 332 in neighboring firing chambers 302 may be substantially larger than the threshold level at which cross-talk may occur.

Figure 4:
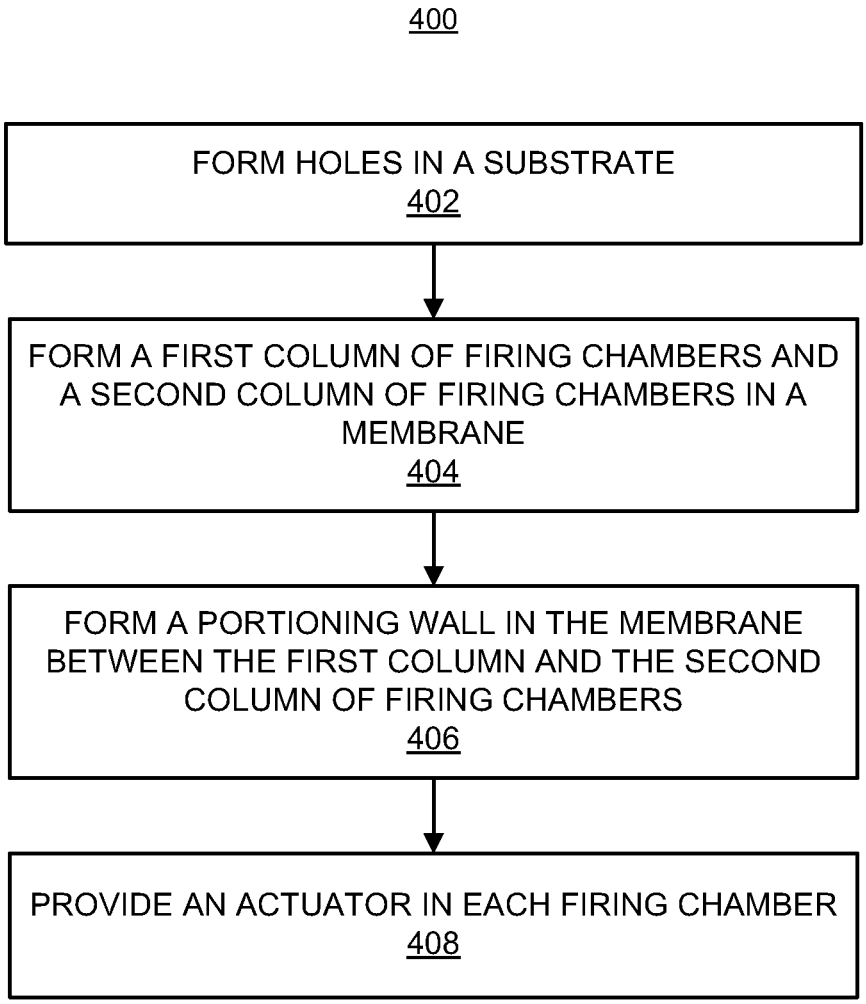
FIG. 4 shows a flow diagram of an example method for fabricating a fluid ejection device.

With reference now to FIG. 4, there is shown a flow diagram of an example method 400 for fabricating a fluid ejection device. It should be understood that the method 400 depicted in FIG. 4 may include additional operations and that some of the operations described therein may be removed and/or modified without departing from the scopes of the method 400. Additionally, it should be understood that the order in which some of the operations in the method 400 are implemented may be switched.

The description of the method 400 is made with reference to the fluid ejection devices 200 and 300 depicted in FIGS. 2A, 2B and 3A-3C for purposes of illustration and thus, it should be understood that the method 400 may be implemented to fabricate fluid ejection devices having other configurations.

At block 402, a plurality of holes may be formed on a substrate 230, 330. The holes may be formed through etching of the substrate 230, 330. In addition, the holes may be formed as fluid feed holes 232 (fluid ejection device 200) or as nozzles 332 (fluid ejection device 300).

At block 404, a first column 206, 306 of firing chambers 202, 302 and a second column 208, 308 of firing chambers 202, 302 may be formed in a membrane 204, 304. The firing chambers 202, 302 may be formed in the membrane 204, 304 through etching or other suitable semiconductor fabrication process. In forming the firing chambers 202, 302, a plurality of side walls 212, 312 may be formed between adjacent ones of the firing chambers 202, 302 along the first columns 206, 306 and along the second columns 208, 308. In addition, back walls (not shown) may be formed in the membrane 204 along the opposite ends of the side walls 212 from the portioning wall 210. The back walls may not be provided to enable fluid from a fluid feed slot to be delivered into the firing chambers 202 through the rear ends of the firing chambers 202, for instance, in instances in which the fluid feed holes 232 become blocked or clogged.

At block 406, a portioning wall 210, 310 may be formed in the membrane 204, 304 between the first column 206, 306 of firing chambers 202, 302 and the second column 208, 308 of firing chambers 202, 302. As discussed herein, the portioning wall 210, 310 may cause a fluid path between the firing chambers 202, 302 in the first column 206, 306 and the second column 208, 308 to be of sufficient length to reduce or minimize cross-talk.

At block 408, an actuator 220, 320 may be provided in each of the firing chambers 202, 302. The actuators 220, 320 may be provided on the substrate 230, 330.

A nozzle layer 240 containing nozzles 242 may also be provided on the membrane 204, for instance, as shown in FIG. 2B. The nozzle layer 240 may function as a fluid barrier above the side walls 212 between the firing chambers 202. In addition, the nozzles 242 may be aligned with respective actuators 220 such that activation of the actuators 220 may cause fluid to be expelled through the nozzles 242.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A fluid ejection device comprising:

a membrane including:

a first column of firing chambers;

a second column of firing chambers adjacent and staggered relative to the first column of firing chambers; and a portioning wall adjacent to and physically separating the first column of firing chambers and the second column of firing chambers;

a plurality of actuators, wherein an actuator of the plurality of actuators is provided in each of the firing chambers; and a substrate below the membrane and including a plurality of holes, wherein each hole extends through the substrate and fluidically connects just to a different respective firing chamber of the first column or of the second column.

2. The fluid ejection device according to claim 1, wherein the firing chambers in the first column of firing chambers are physically separated from adjacent firing chambers in the first column of firing chambers by side walls and wherein the firing chambers in the second column of firing chambers are physically separated from adjacent firing chambers in the second column of firing chambers by side walls.

3. The fluid ejection device according to claim 2, wherein the side walls have widths that are greater than a width of the portioning wall.

4. The fluid ejection device according to claim 2, wherein the firing chambers in the first column of firing chambers and the second column of firing chambers further comprise a respective back wall that connects to the side walls opposite to the portioning wall.

5. The fluid ejection device according to claim 1, further comprising:

a nozzle layer provided on the membrane, said nozzle layer comprising a plurality of nozzles, wherein each of the plurality of nozzles is directly above and in fluid communication with a respective one of the firing chambers.

6. The fluid ejection device according to claim 1, wherein the substrate comprises a thickness that between about 50 microns and about 150 microns.

7. The fluid ejection device according to claim 1, wherein a closest distance between the actuators in the first column of firing chambers and the actuators in the second column of firing chambers is less than about 100 microns.

8. A method for fabricating a fluid ejection device, said method comprising:

forming holes in a substrate, the holes extending through the substrate;

forming a membrane above the substrate and including a first column of firing chambers and a second column of firing chambers adjacent and staggered relative to the first column of firing chambers, wherein each hole is in fluidic communication just with a different respective firing chamber of the first column or of the second column;

forming a portioning wall in the membrane adjacent to and separating the first column of firing chambers and the second column of firing chambers; and providing an actuator in each of the firing chambers, wherein each of the actuators is to eject fluid from a respective firing chamber when actuated.

9. The method according to claim 8, further comprising:

forming side walls in the membrane to physically separate the firing chambers in the first column of firing chambers from adjacent firing chambers in the first column of firing chambers; and forming side walls in the membrane to physically separate the firing chambers in the second column of firing chambers from adjacent firing chambers in the second column of firing chambers.

10. The method according to claim 8, further comprising:

forming a first back wall in the membrane that extends across the firing chambers in the first column of firing chambers opposite the portioning wall; and forming a second back wall in the membrane that extends across the firing chambers in the second column of firing chambers opposite the portioning wall.

11. The method according to claim 8, further comprising:

providing a nozzle layer on the membrane, said nozzle layer comprising a plurality of nozzles, wherein each of the plurality of nozzles is directly above and in fluid communication with a respective one of the firing chambers.

12. A printhead assembly comprising:

a plurality of fluid ejection devices, each of the plurality of fluid ejection devices comprising:

a membrane including:

a first column of firing chambers;

a second column of firing chambers adjacent and staggered relative to the first column of firing chambers; and a portioning wall adjacent to and physically separating the first column of firing chambers and the second column of firing chambers;

a plurality of actuators, wherein an actuator of the plurality of actuators is provided in each of the firing chambers adjacent to the portioning wall; and a substrate below the membrane and having a plurality of holes that each extend through the substrate and fluidically connect just to a different respective firing chamber of the first column or of the second column.

13. The printhead assembly according to claim 12, wherein the membranes in each of the plurality of fluid ejection devices further comprise side walls that physically separate adjacent firing chambers in the first column of firing chambers from each other and physically separate adjacent firing chambers in the second column of firing chambers from each other.

14. The fluid ejection device of claim 1, wherein each hole is fluidically connected to just one firing chamber of the first column or of the second column, and each firing chamber of the first and second columns is fluidically connected to just one hole.

* * * * *